US006326871B1

(12) United States Patent
Freimuth

(10) Patent No.: US 6,326,871 B1
(45) Date of Patent: Dec. 4, 2001

(54) SWITCHGEAR UNIT OF A SWITCHING DEVICE AND A COUPLED LEADING AUXILIARY SWITCH

(75) Inventor: Michael Freimuth, Hirschau (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/555,810

(22) PCT Filed: Nov. 23, 1998

(86) PCT No.: PCT/DE98/03451

§ 371 Date: Aug. 2, 2000

§ 102(e) Date: Aug. 2, 2000

(87) PCT Pub. No.: WO99/30339

PCT Pub. Date: Jun. 17, 1999

(30) Foreign Application Priority Data

Dec. 5, 1997 (DE) ..... 197 54 072

(51) Int. Cl.[7] ..... H01H 9/00

(52) U.S. Cl. ..... 335/172; 335/20

(58) Field of Search ..... 335/14, 22, 167–172, 335/185–195, 200, 132; 200/293–308

(56) References Cited

U.S. PATENT DOCUMENTS

| | | | | |
|---|---|---|---|---|
| 4,801,907 | * | 1/1989 | Kelaita, Jr. et al. | 335/20 |
| 4,806,893 | * | 2/1989 | Castonguay et al. | 335/20 |
| 4,901,046 | | 2/1990 | Alsch . | |
| 5,657,002 | * | 8/1997 | Ogden | 340/650 |
| 5,886,641 | * | 3/1999 | Ulerich et al. | 335/14 |

FOREIGN PATENT DOCUMENTS

| | | |
|---|---|---|
| 38 20 113 | 11/1989 | (DE) . |
| 43 10 863 | 5/1994 | (DE) . |
| 197 03 973 | 5/1998 | (DE) . |
| 2 684 231 | 5/1993 | (FR) . |

* cited by examiner

*Primary Examiner*—Lincoln Donovan
(74) *Attorney, Agent, or Firm*—Birch, Stewart, Kolasch & Birch, LLP

(57) ABSTRACT

A switchgear unit having a switching device which has a rotary operating mechanism (12) and a breaker mechanism and having a leading auxiliary switch (1) coupled to it is provided. The switching device has a gate guide (15) which is in operative connection with a projection (9) on the contact bridge carrier of the auxiliary switch (1).

6 Claims, 6 Drawing Sheets

SWITCHGEAR UNIT OF A SWITCHING DEVICE AND A COUPLED LEADING AUXILIARY SWITCH

FIELD OF THE INVENTION

Figure 1:
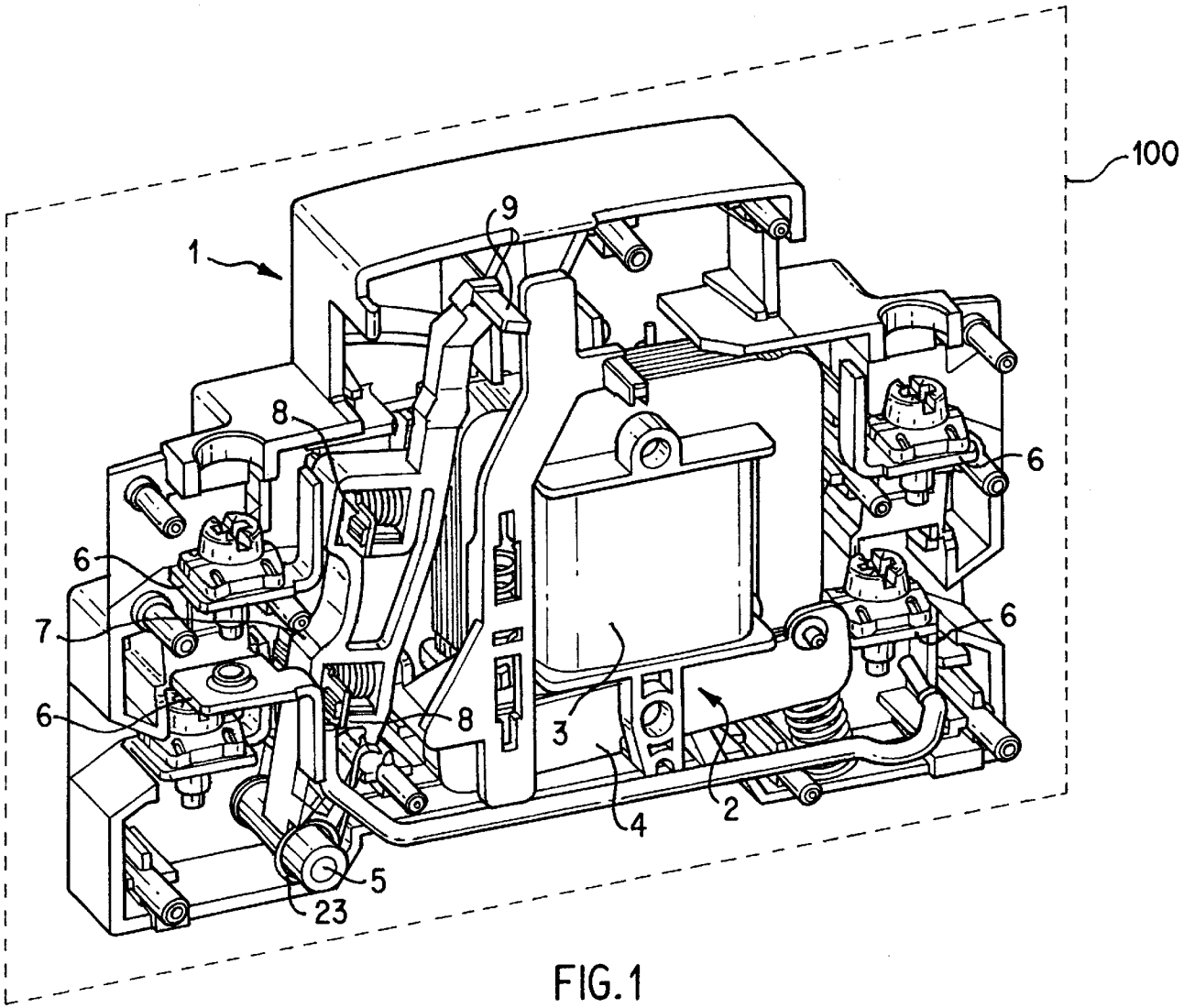

The present invention relates to a switchgear unit which has a switching device having a rotary operating mechanism and a breaker mechanism, as well as a coupled undervoltage release having a leading auxiliary switch having a contract bridge carrier which has moving contacts as well as fixed contacts that contact the moving contacts.

BACKGROUND OF THE INVENTION

Generic switchgear units have been available from switchgear manufacturers for a long time. However, conventional switchgear have a complicated and expensive mechanical design.

SUMMARY

Therefore, the object of the present invention is to create a switchgear unit of the type defined above, permitting implementation of an undervoltage release having a leading auxiliary switch in a simple manner.

German Patent 38 20 113 describes a switchgear unit having a switching device having a rotary operating mechanism and a breaker mechanism. The switching device is a power circuit-breaker, and having a coupled auxiliary switch or a signal switch which has a contact bridge carrier having moving contacts and fixed contacts that can be contacted with the moving contacts. The additional switch that can be coupled is not a undervoltage release having a leading auxiliary switch. This power circuit-breaker has a latch which is accessible through an opening in the side wall and also trips a latch of the additional switch in the event of a short circuit of the switching device. It is possible here to set the function as an auxiliary switch or as a signal switch or as a relative auxiliary switch not only before mounting on the respective power circuit-breaker or before assembly with other such auxiliary switches and signal switches, but also this can be done subsequently in the assembled state on the hard-wired device without any additional assembly work. This is achieved by arranging a trip-free circuit-breaker between an operating knob and a blocking device of the auxiliary switch so that it can be lifted as needed by a coupling element. The coupling element is designed as a pluggable connecting shoe having on its upper end fact the marking "Hi" to characterize its function as an auxiliary switch when the connecting shoe is attached. In this function, the original function of the additional switch as a relative auxiliary switch or as a signal switch bearing the marking "RHi" on the end face of the operating knob is covered by the connecting shoe, so that the respective function of the additional switch can easily be determined on the basis of the markings on the connecting shoe and on the operating knob.

This object is achieved by the fact that the switching device has a gate guide which is in operative connection with a projection on the contact bridge carrier of the auxiliary switch and acts on the contact bridge carrier in a first actuating phase of the actuating element in such a way that the ON position is reached between the moving contacts and the fixed contacts, and during the subsequent second actuating phase for actuating of the breaker mechanism, the ON position of the contacts of the auxiliary sqitch is maintained.

The switchgear unit according to the present invention is characterized in that the bridge carrier can be operated directly via its projection without additional intermediary elements. This projection can easily be designed as an integrally molded part which is easily brought into its ON position by a rotating contact bridge carrier.

the rotary operating mechanism is advantageously designed to have a finger-grip knob as an actuating element.

It is also advantageous if the finger-grip knob has a wheel designed with a contour as a gate guide for a wing handle acting on the projection. This contour in the form of a gate guide permits easy implementation of the first and second actuating gate.

An especially simple design is obtained when, in the first actuating phase, the wing handle pivots the contact bridge carrier via its projection into the ON position. In this way there is a direct transfer of the rotational drive to the contact bridge carrier without other intermediary elements.

In order to save space, e.g., in the case of installation in a switchgear cabinet, it is advabtageous if the switching device and the auxiliary switch are connected by side walls.

Figure 2:
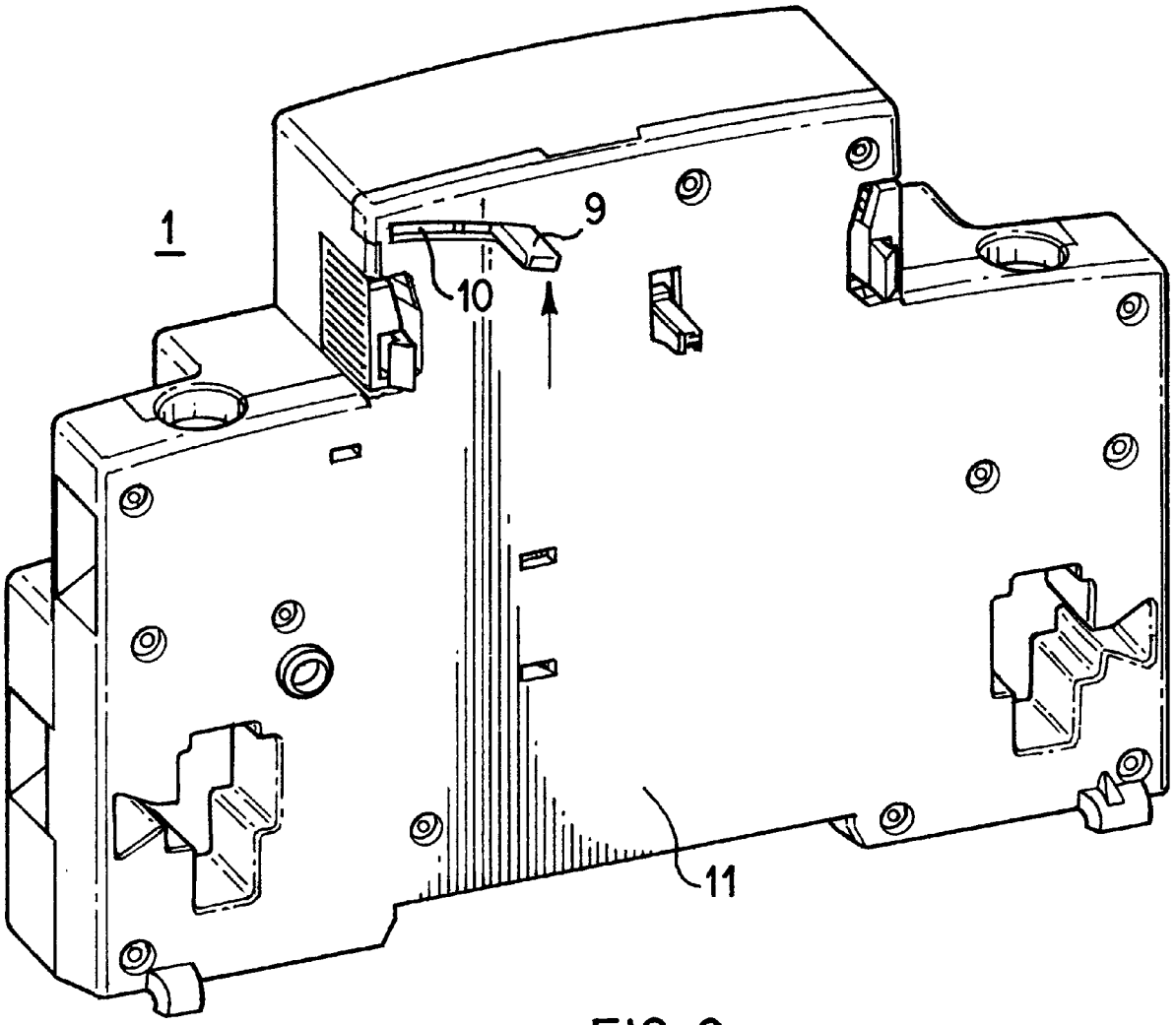
Figure 3:
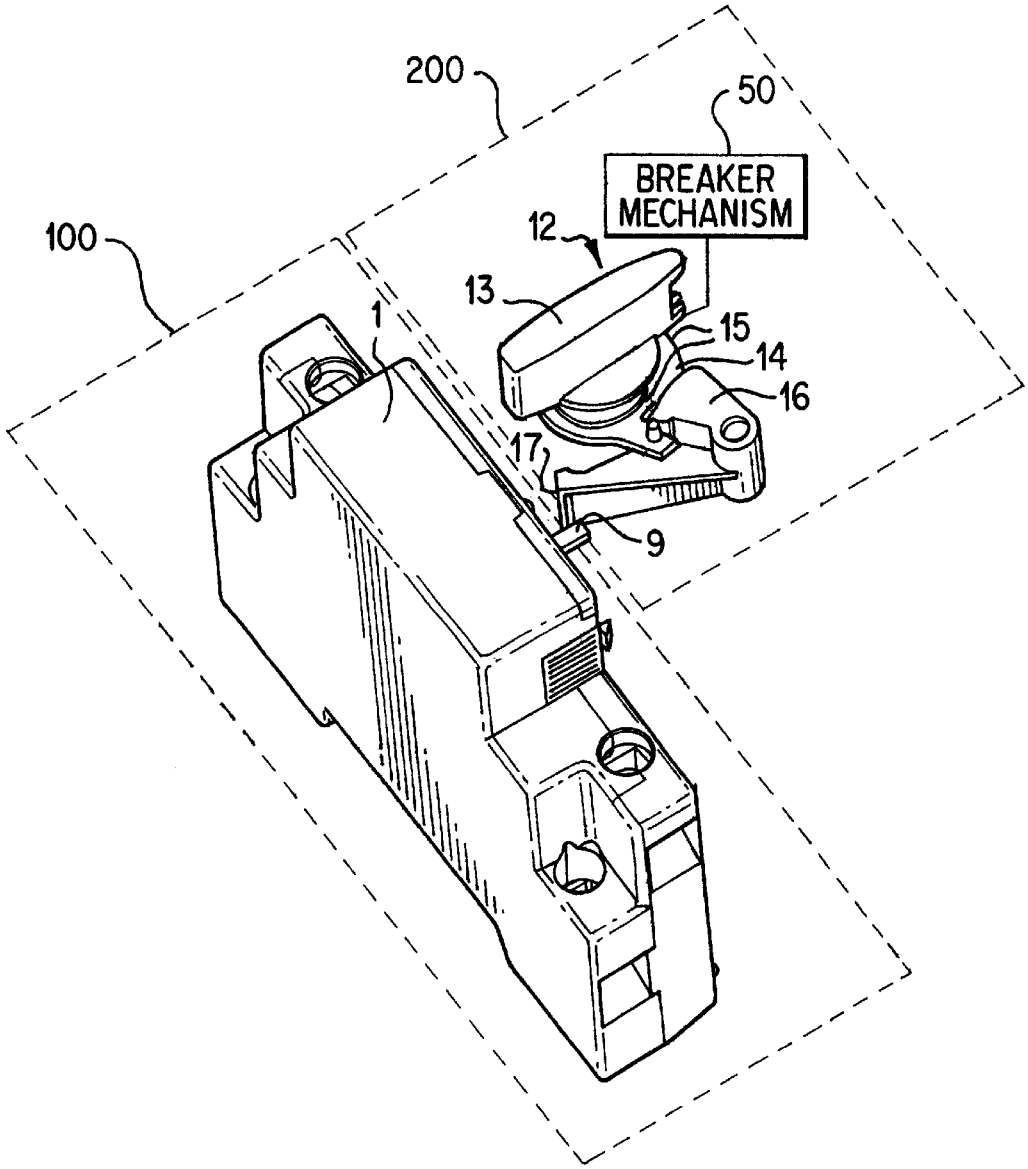
Figure 4:
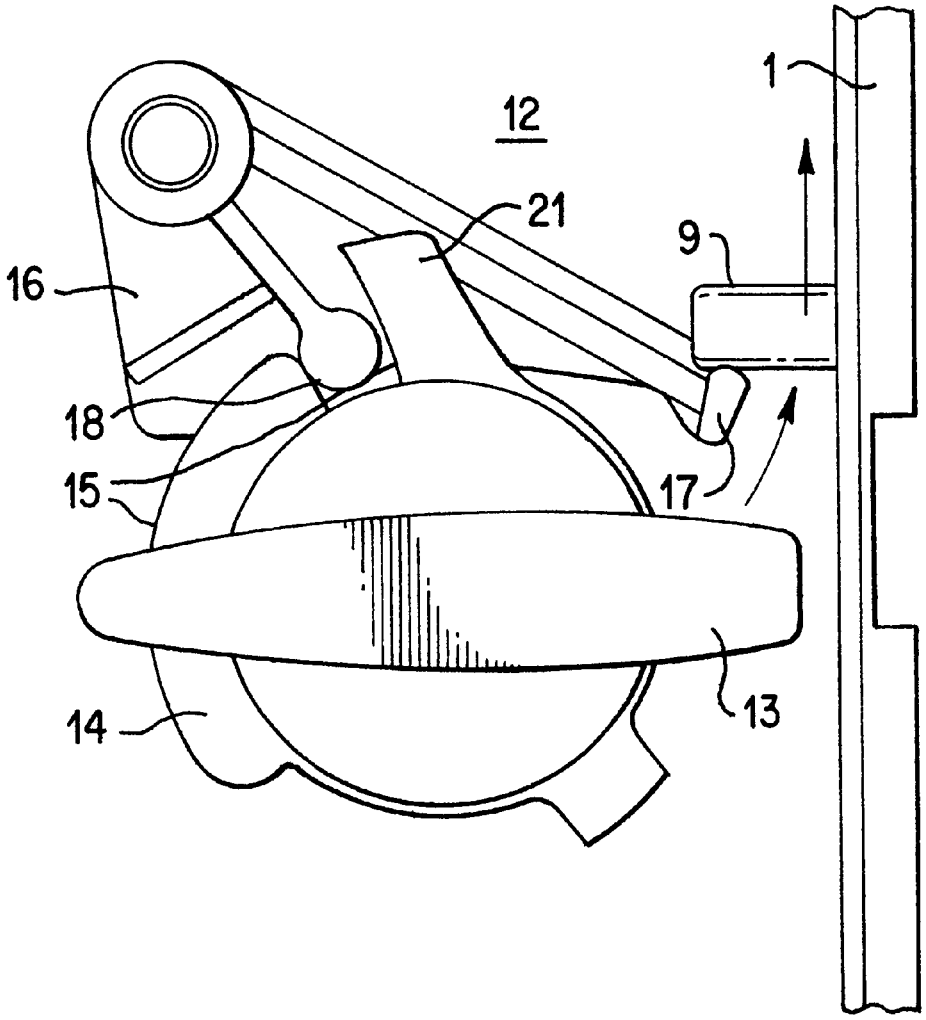
Figure 5:
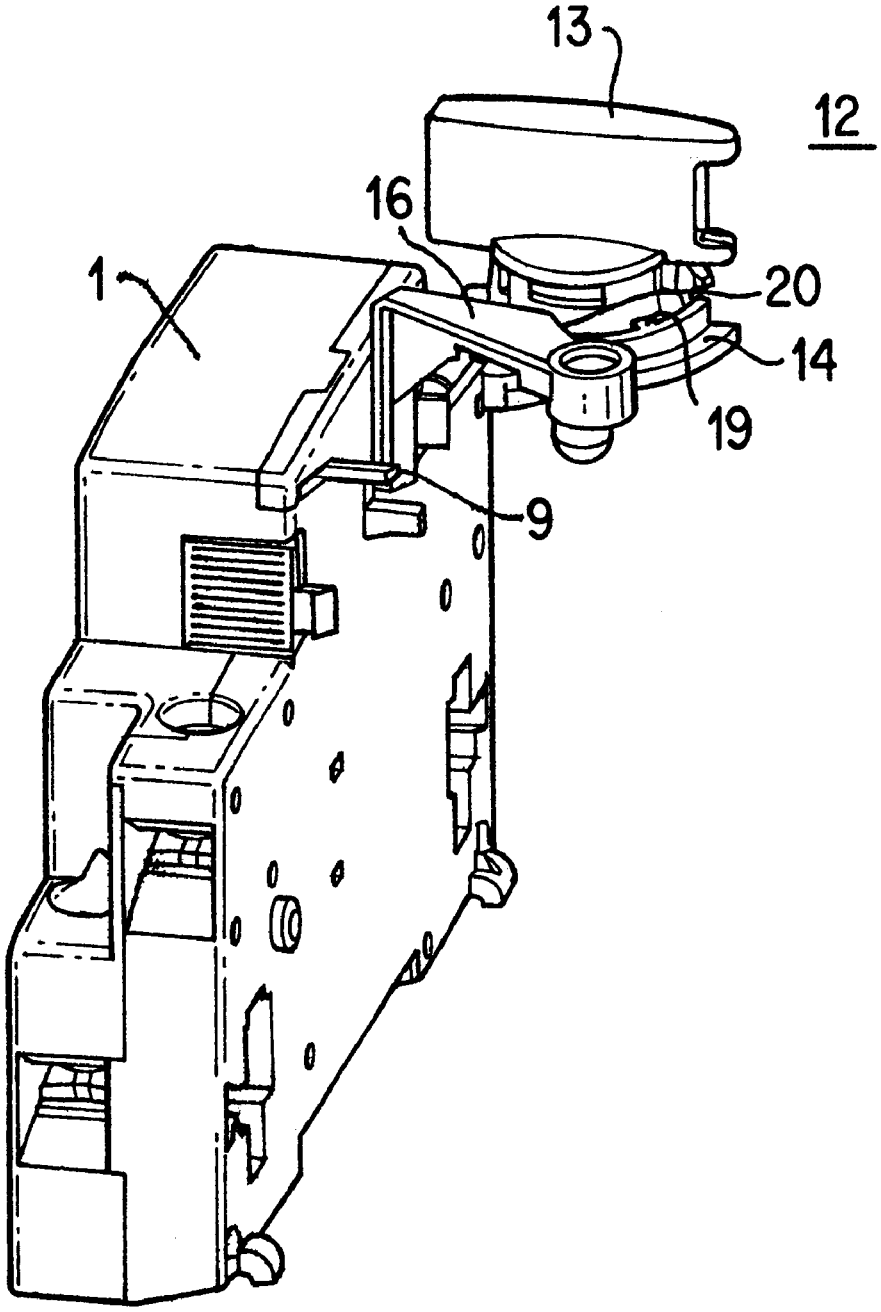
Figure 6:
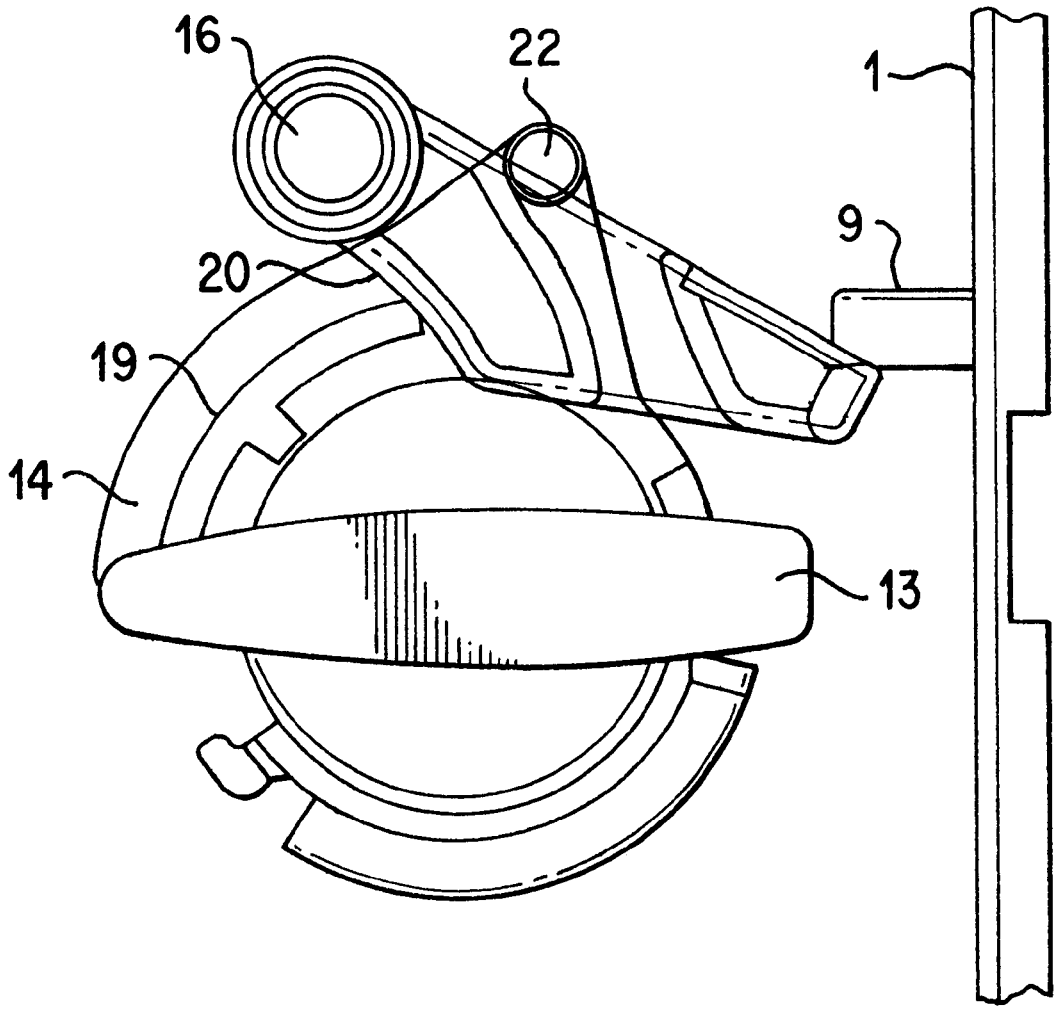

An embodiment of the present invention is explained in greater detail below on the basis of a drawing, which shows:

FIG. 1: an inside view of an auxiliary switch according to the present invention;

FIG. 2: a view of the complete auxiliary switch according to FIG. 1 with its mounting wall;

FIG. 3: the auxiliary switch according to FIGS. 1 and 2 in its interaction with the rotary operating mechanism of a switching device;

FIG. 4: a schematic diagram of the rotary operating mechanism of the switching device in operative connection with the auxiliary switch;

FIG. 5: a perspective view of the rotary operating mechanism of the switching device in operative connection with the auxiliary switch;

FIG. 6 shows a schematic diagram of the operative connection of the rotary operating mechanism according to FIG. 5 having an auxiliary switch.

DETAILED DESCRIPTION

FIGS. 5 and 6 show an alternative embodiment of a rotary operating mechanism 12, where finger-grip knob 13 is again connected to a wheel 14 having a web 19 as a contour as a gate guide. Wing handle 16 for actuating projection 9 is provided here with an arc-shaped edge 20 with which web 19 is in contact in the in the first actuating phase of finger-grip knob 13. When finger-grip knob 13 is operated, wing handle 16 is again turned and thereby presses contact carrier 7 into the ON position via its projection 9. After reaching this ON position, wing handle 16 is held in its unchanged position via circular web 19, while the breaker mechanism (not shown here) of the switching device is actuated by finger-grip knob 13 in this second actuating phase. In the shutdown cycle, a torsion spring 23 acting on contact carrier 7 according to FIG. 1 presses wing handle 16 back into its initial position. With a non-integral undervoltage release having a leading auxiliary switch 1, grip lever 21 in FIG. 4 and pin 22 in FIG. 6 causes this return movement of wing handle 16. Both are go engaged with wing handle 16 in shutdown.

What is claimed is:

1. A switchgear unit, comprising:

a switching device including a rotary operating mechanism and a breaker mechanism, the rotary operating mechanism including an actuating element; and an undervoltage release coupled to the switching device, the undervoltage release including a leading auxiliary switch, the auxiliary switch including a contact carrier including moving contacts and fixed contacts which contact the moving contacts, the auxiliary switch further including a projection which projects through an opening in a side wall of the auxiliary switch, the rotary operating mechanism being in operative connection with the projection, the rotary operating mechanism acting on the contact carrier in a first actuating phase of the actuating element so that an ON position is reached between the moving contacts and the fixed contacts, wherein the breaker mechanism is actuated only during a second actuating phase while in the ON position of the moving contacts and the fixed contacts is maintained, the second actuating phase being subsequent to the first actuating phase.

2. The switchgear unit according to claim 1, wherein the rotary operating mechanism includes a finger-grip knob as the actuating element.

3. The switchgear unit according to claim 2, wherein the finger-grip knob includes a wheel having a contour as a gate guide for a wing handle acting on the projection.

4. The switchgear unit according to claim 3, wherein in the first actuating phase, the wing handle swivels the contact carrier into the ON position via the projection.

5. The switchgear unit according to claim 1, wherein the switching device and the undervoltage release are coupled together via sidewalls.

6. The switchgear unit according to claim 3, further comprising:

a restoring element to return the wing handle to an OFF position.

* * * * *